US008082984B2

(12) United States Patent
Richard et al.

(10) Patent No.: US 8,082,984 B2
(45) Date of Patent: Dec. 27, 2011

(54) LARGE BORE PACKER AND METHODS OF SETTING SAME

(75) Inventors: Bennett M. Richard, Kingwood, TX (US); Edward O'Malley, Houston, TX (US); Yang Xu, Houston, TX (US); Peter Fay, Houston, TX (US); Larry Urban, Santa Fe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/070,360

(22) Filed: Mar. 23, 2011

(65) Prior Publication Data

US 2011/0168412 A1 Jul. 14, 2011

Related U.S. Application Data

(62) Division of application No. 12/711,029, filed on Feb. 23, 2010, now Pat. No. 7,963,322, which is a division of application No. 12/436,416, filed on May 6, 2009, now Pat. No. 7,694,746, which is a division of application No. 11/595,465, filed on Nov. 9, 2006, now abandoned.

(51) Int. Cl.
*E21B 43/10* (2006.01)
*E21B 23/00* (2006.01)

(52) U.S. Cl. ..... 166/207; 166/206; 166/384; 166/387

(58) Field of Classification Search ..... 166/206, 166/207, 384, 387
See application file for complete search history.

(56) References Cited

U.S. PATENT DOCUMENTS

| | | | | |
|---|---|---|---|---|
| 6,354,373 | B1 * | 3/2002 | Vercaemer et al. | 166/277 |
| 6,907,652 | B1 * | 6/2005 | Heijnen | 29/447 |
| 6,966,368 | B2 * | 11/2005 | Farquhar | 166/128 |
| 2004/0256111 | A1 * | 12/2004 | Burge et al. | 166/380 |
| 2005/0001429 | A1 * | 1/2005 | Abercrombie Simpson | 285/382 |
| 2005/0011650 | A1 * | 1/2005 | Harrall et al. | 166/380 |
| 2007/0266756 | A1 * | 11/2007 | Shuster et al. | 72/370.06 |

* cited by examiner

*Primary Examiner* — Giovanna Wright
(74) *Attorney, Agent, or Firm* — Shawn Hunter

(57) ABSTRACT

Devices and methods for setting a packer inside a wellbore with little appreciable reduction of the useable area of the wellbore. The outer casing or liner of the wellbore contains one or more integrated casing coupler joints having an increased diameter chamber portion. A large bore packing element is carried within the increased diameter chamber portion. The packing element may be selectively actuated to form a seal against an interior tubular member. Because the packing element is located within the chamber portion of the casing coupler, the packer may be set while saving useable cross-sectional area within the casing.

15 Claims, 6 Drawing Sheets

LARGE BORE PACKER AND METHODS OF SETTING SAME

This application is a divisional application of U.S. patent application Ser. No. 12/711,029 filed Feb. 23, 2010, now U.S. Pat. No. 7,963,322 which was a divisional application of U.S. patent application Ser. No. 12/436,416 filed May 6, 2009 (now U.S. Pat. No. 7,694,746) and which was a divisional application of U.S. patent application Ser. No. 11/595,465, filed on Nov. 9, 2006 now abandoned.

BACKGROUND OF THE INVENTION

1. Field of the Invention

The invention relates generally to methods and packer devices that can be set within a wellbore with little or no reduction in useable cross-sectional bore area.

2. Description of the Related Art

Wellbore packers are used for securing production tubing inside of casing or a liner within a wellbore. Packers are also used to create separate zones within a wellbore. Unfortunately, conventional packers and techniques for setting packers results in a reduction of usable diameter within the well. This is because the packer is carried by a conveyance tubular (such as a production tubing string) that is of smaller diameter than the tubing or casing against which it is set. The packer is then set within the annular space between the conveyance tubular and the outer tubing or casing. Once set, the useable diameter of the well (i.e., the diameter through which production fluid can flow or tools can be passed) becomes the inner diameter of the conveyance tubular. However, the components of the packer device (including slips, elastomeric seals, setting sleeves and so forth) inherently occupy space between the inner and outer tubulars. For example, a wellbore having standard 21.40 lb. casing with an outer diameter of 5 inches, would have an inner diameter of 4.126 inches. It would be desirable to run into the casing a string of tubing having an outer diameter of approximately 4 inches, which would allow for a tubing string with a large cross-section area for fluid flow and tool passage. However, the presence of packer components on the outside of the tubing string will dictate that a smaller size tubing string (such as 2⅞") be run. Over an inch of diameter in usable area is lost due to the presence of both the inner production tubing string and the packer device that is set within the space between the production tubing string and the casing.

The present invention addresses the problems of the prior art.

SUMMARY OF THE INVENTION

The invention provides devices and methods for setting a packer inside a wellbore with little appreciable reduction of the useable area of the wellbore. In described embodiments, the outer casing or liner of the wellbore contains one or more integrated casing coupler joints having an increased diameter chamber portion. A large bore packing element is carried within the increased diameter chamber portion. The packing element may be selectively actuated to form a seal against an interior tubular member. Because the packing element is located within the chamber portion of the casing coupler, the packer may be set while saving useable cross-sectional area within the casing. In the instance of the 5 inch casing situation described above, an interior tubing string having a four inch diameter could be run into the exterior casing or liner.

Rather than being conveyed into the wellbore on the tubing string, the packer device is already disposed within the well prior to running of the tubing string. They are then activated using activation components that are run into the wellbore on the tubing string.

In one embodiment, the packer device comprises an axially compressible sealing element that may be formed of a ductile metal. The ductile metal may be integrated with elastomeric or non-elastomeric sealing elements, if desired. The sealing element is axially compressed by camming action by a setting sleeve member that is also located within the increased diameter portion of the casing coupler. The setting sleeve preferably includes an engagement profile that can be engaged by a complimentary engagement member, which may be integrated into the tubing string.

In a second described embodiment, the compressible element of the packer device is set by a coarsely threaded setting sleeve that is helically moveably engaged with an interior surface of the casing coupler. The threaded setting sleeve includes a rotational engagement key that can be engaged by a complimentary engagement member, which may be carried on the tubing string that is inserted into the casing string. To set the packer device, the setting sleeve is rotated with respect to the casing coupler.

In a third described embodiment, the element is set by moveable conical surface that urges the sealing element radially inwardly and against the tubing string. In further exemplary embodiments, the packer device is set by an energizing setting power source that is retained within the wellbore casing and preferably within the casing coupler itself. The power source can comprise a fluid chamber or a compressed spring. The tubing string is adapted to release or energize the stowed energy source. The release or energization may be accomplished a number of ways, including the use of a latch member to engage a portion of the energy source and release it or by use of a tag device, such as an RFID (radio frequency identification) tag that will release or energize the power source upon electronic recognition. If desired, a delay could be incorporated into the setting mechanism.

In a further described embodiment, the packer device is actuated hydraulically via fluid that is pumped down the production tubing string and into the enlarged diameter chamber. In still another described embodiment, a ductile tube is attached to the tubing string and, by hydraulic or mechanical methods, the ductile tube is inflated radially outwardly and forms a metal-to-metal or metal-to-non-metal seal with the sealing device contained within the casing coupler.

BRIEF DESCRIPTION OF THE DRAWINGS

For a thorough understanding of the present invention, reference is made to the following detailed description of the preferred embodiments, taken in conjunction with the accompanying drawings in which like reference characters designate like or similar elements throughout the several figures of the drawing.

DETAILED DESCRIPTION OF THE PREFERRED EMBODIMENTS

Figure 2:
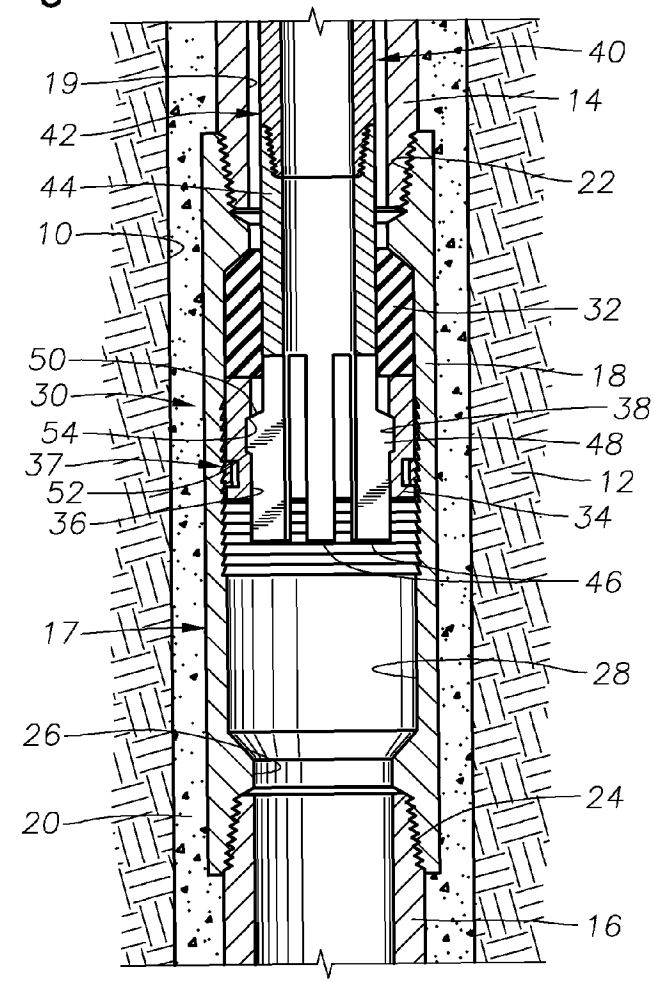
FIG. 2 is a side, cross sectional view of the packer device shown in FIG. 1, now having been set.
Figure 1:
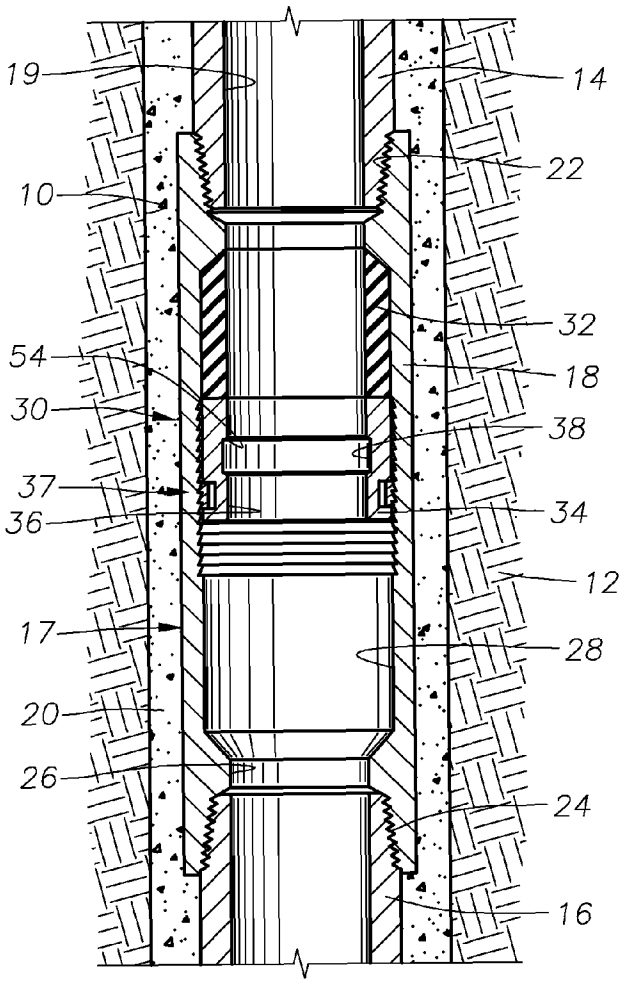
FIG. 1 is a side, cross sectional view of an exemplary packer device constructed in accordance with the present invention.

FIGS. 1 and 2 illustrate an exemplary wellbore 10 that has been drilled through the earth 12. The wellbore 10 is lined with a string of casing, of which two casing sections 14, 16 are depicted. A casing coupler 18 interconnects the casing sections 14, 16 to form a casing string 17 that defines a central bore 19 along its length. Cement 20 surrounds the casing sections 14, 16 and casing coupler 18. It is noted that the casing coupler 18 has a greater diameter than the casing sections 14, 16 and is secured to each of the casing sections 14, 16 via threaded connections 22, 24, respectively.

The casing coupler 18 includes an axial bore 26 for passage of tools and fluid through the casing coupler 18. The bore 26 has an enlarged diameter chamber portion 28. A packer device 30 is disposed within the enlarged diameter chamber portion 28. The packer device 30 includes a cylindrical elastomeric packer sealing element 32 and a cylindrical setting sleeve 34. The setting sleeve 34 is a compression member that is axially moveable within the enlarged diameter portion 28 of the bore 26. The setting sleeve 34 features an axial bore 36 with an engagement profile 38 within. A ratchet-style body lock ring assembly 37, of a type known in the art, is associated with the outer radial diameter surface of the setting sleeve 34. The body lock ring assembly 37 provides for limited one-way movement of the setting sleeve 34 with respect to the surrounding casing coupler 18.

FIGS. 1 and 2 depict actuation of the packer device 30 to create a seal between the casing string 17 and a string of production tubing 40, the lower end of which is visible in FIG. 2. The lower end of the production tubing string 40 includes a setting tool 42 for actuation of the packer device 30. In FIG. 1, the packer device 30 is in an initial, unset position. In one embodiment, the setting tool 42 includes a cylindrical tool body 44 having a plurality of collets 46 extending axially therefrom. Each of the collets 46 carries a radially enlarged portion 48 that presents a stop shoulder 50 and a tapered camming surface 52. The enlarged portion 48 is shaped and sized to fit within the engagement profile 38 of the setting sleeve 34.

To activate the packer device 30, the production tubing string 40 and setting tool 42 are inserted into the casing string 17. The tapered camming surface 52 of each collet 46 will contact the upper ends of the sealing element 32 and the setting sleeve 34 and deflect the collet 46 radially inwardly. When the radially enlarged portion 48 of each collet 46 becomes aligned with the engagement profile 38 of the setting sleeve 34, each collet 46 will snap radially outwardly so that the radially enlarged portion 48 becomes disposed within the engagement profile 38, as shown in FIG. 2. Once the setting tool 42 is attached to the setting sleeve 34 in this manner, the tubing string 40 is then pulled upwardly to cause the setting sleeve 34 to be moved axially upwardly within the enlarged diameter portion 28 of the bore 26. The collets 46 are not disengaged from the engagement profile 38 due to abutting contact between the stop shoulder 50 and the upper end 54 of the profile 38. The sealing element 32 is thereby axially compressed by the setting sleeve 34 and, when axially compressed, will be extruded radially inwardly against the tool body 44 of the production tubing string 40. The body lock ring assembly 37 will prevent the setting sleeve 34 from moving back downwardly with respect to the surrounding casing coupler 18, thereby preventing the packer device 30 from becoming unset.

Because the components of the packer device 30 are retained within an enlarged diameter portion 28 of the casing coupler 18, the gap between the exterior of the tubing string 40 and the interior of the casing string 17 can be quite small. For example, in a casing string made up of 35.3 lb. Casing sections with an external diameter of 5 inches, an interior diameter of 4.126 inches would be available. With the large bore, external packer arrangement described above, it would be possible to insert a tubing string 17 having a diameter approximating 4 inches, rather than a smaller diameter tubing string (i.e., 2⅞"). In fact, the use of a larger diameter tubing string is desirable for two reasons. First, the resulting available cross-sectional flow and work bore area of the tubing string 17 will be larger. Second, the sealing element 32 of the packer device 30 can more easily and securely seal against the larger diameter tubing string 17.

Figure 4:
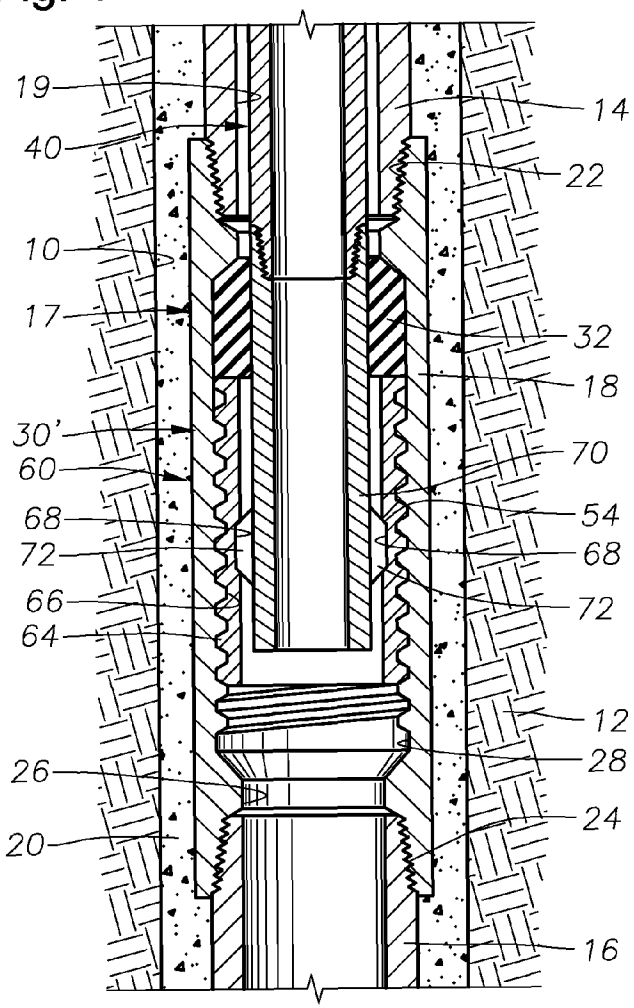
FIG. 4 is a side, cross-sectional view of the packer device shown in FIG. 3, now with having been set.
Figure 3:
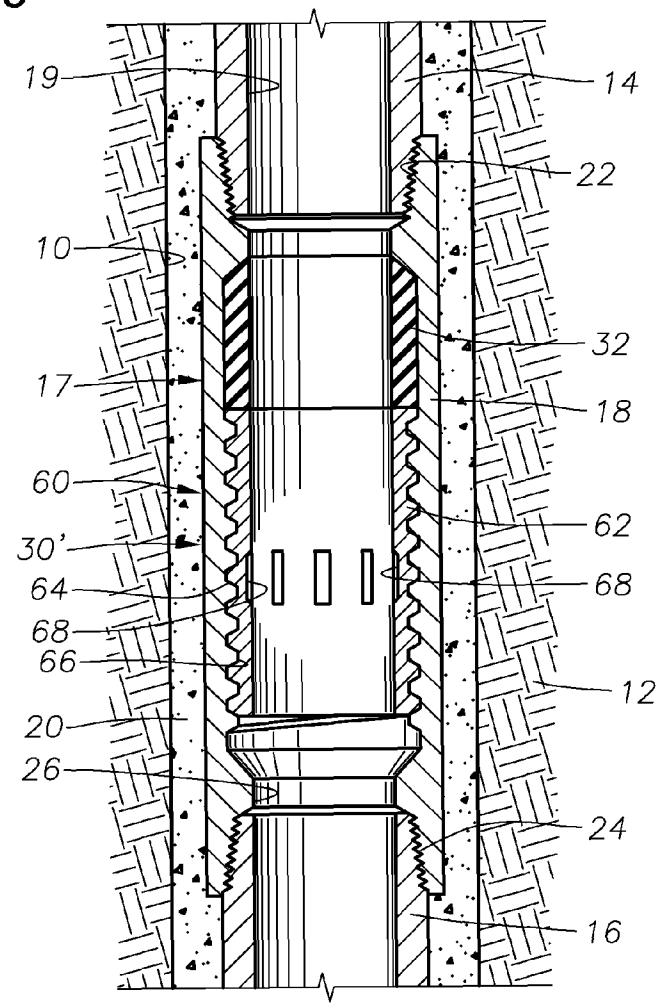
FIG. 3 is a side, cross-sectional view of an alternative packer device constructed in accordance with the present invention.

FIGS. 3 and 4 illustrate an alternative embodiment of the invention wherein a packer device 30' has a sealing element 32 and a setting sleeve assembly 60. The setting sleeve assembly 60 includes an inner setting sleeve member 62 having an external helical thread 64 and an internal helical thread 66 that is formed on the interior of the enlarged diameter portion 28. It is noted that the external and internal threads 64, 66 are interengaged with one another in a well-known manner such that rotation of the sleeve member 62 within the casing coupler 18 will move the sleeve member 62 axially within the coupler 18. One or more key slots 68 are located on the radial interior of the sleeve member 62.

In FIG. 3, the packer device 30' is in an unset, initial position. In FIG. 4, a production tubing string 40 has been inserted into the casing string 17. A setting component 70 is secured to the lower end of the production tubing string 40 and presents radially extending keys 72 that are shaped and sized to fit within the key slots 68. It is noted that the keys 72 are preferably spring-biased radially outwardly from the body of the setting component 70 so that they may be compressed radially inwardly as needed for disposal down through the casing string 17 and to pop radially outwardly upon encountering the key slots 68. When the keys 72 are located within the key slots 68, the inner sleeve member 62 is secured rotationally with respect to the setting component 70 such that rotating the tubing string 40 and setting component 70 will rotate the sleeve member 62. In order to set the packer device 30', the tubing string 40 is rotated at the surface to cause the sleeve member 62 to move axially upwardly with respect to the casing coupler 18, thereby radially compressing the sealing element 32 and causing it to seal against the tubing string 40. In this embodiment, no body lock ring is required to maintain the packer device 30' in the set position. The inward compressive force exerted by the sealing element 32 upon the outer radial surface of the tubing string 40 should be sufficient to prevent counter-rotation of the tubing string 40 within the casing string 17 that might cause the packer device 30' to become unset.

Figure 6:
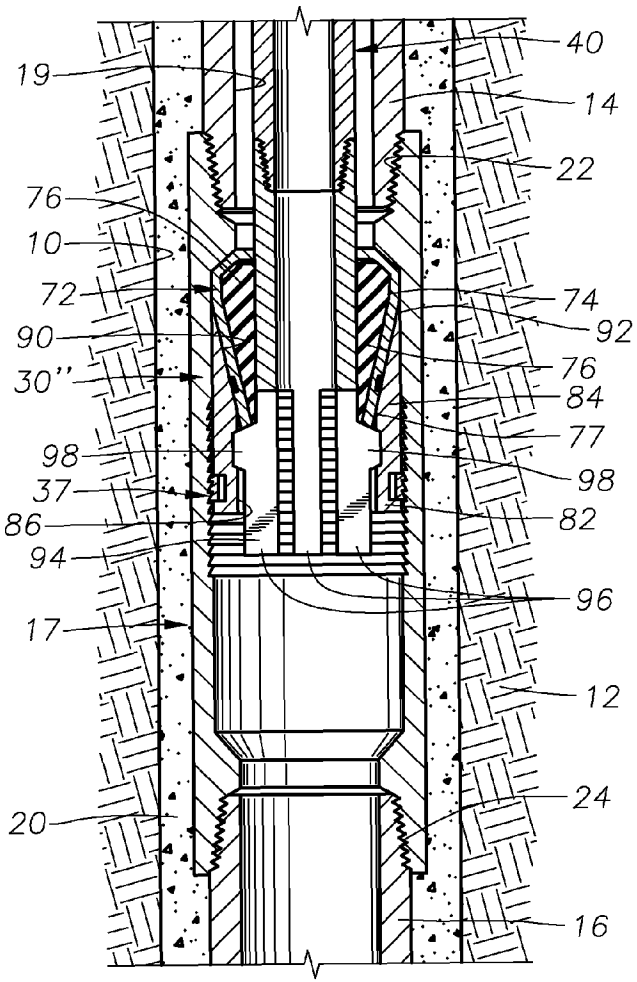
FIG. 6 is a side, cross-sectional view of the packer device shown in FIG. 5, now having been set.
Figure 5:
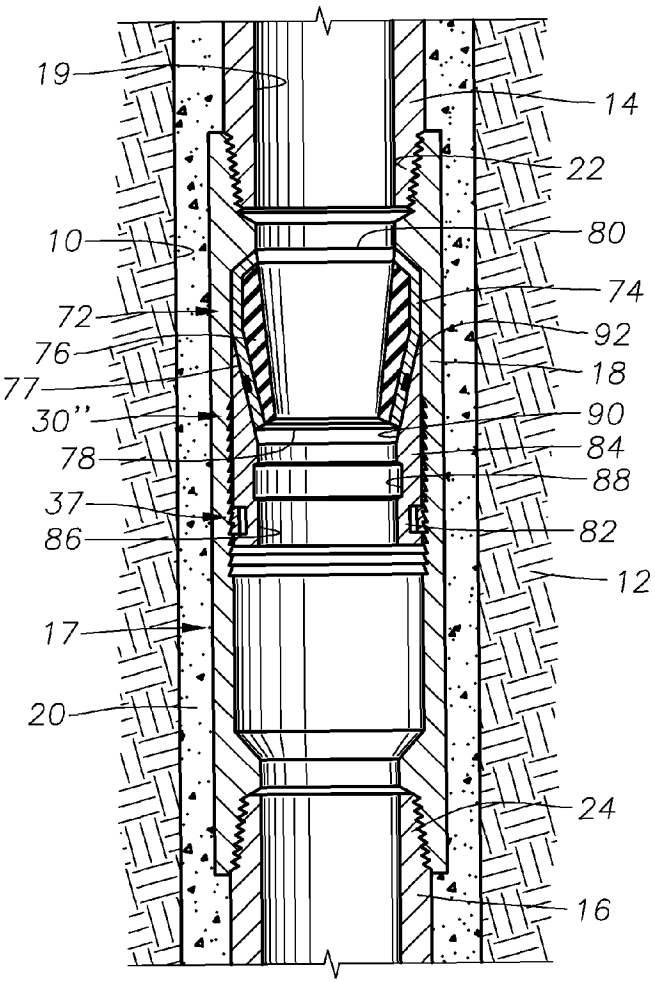
FIG. 5 is a side, cross-sectional view of a further alternative packer device constructed in accordance with the present invention.

FIGS. 5 and 6 depict a further alternative embodiment for a packer device 30" constructed in accordance with the present invention. The packer device 30" includes a sealing element 72 having a ductile metallic body 74 and elastomeric sealing portions 76. A suitable sealing element of this type is the "ZX" packing element that is available commercially from Baker Oil Tools of Houston, Tex. It is noted that the exterior radial surface 77 of the sealing element 72 is substantially conical in shape such that the lower axial end 78 of the sealing element 72 presents a smaller diameter than the upper axial end 80.

Also included in the packer device 30" is a setting sleeve member 82 having a generally cylindrical sleeve body 84 that defines a central axial bore 86 with an interior engagement profile 88. A body lock ring assembly 37 is associated with the outer radial surface of the sleeve body 84 and provides for limited one-way movement of the setting sleeve member 82 with respect to the surrounding casing coupler 18. A tapered bore portion 90 is located proximate the upper end 92 of the body 84 thereby providing a ramped surface that is in abutting contact with the outer radial surface 77 of the sealing element 72.

FIG. 5 depicts that packer device 30" in an unset condition. In FIG. 6, a production tubing string 40 has been disposed into the casing string 17. A setting tool component 94 is secured to the lower end of the tubing string 40 and presents axially extending collets 96 with radially outwardly projecting portions 98 that are shaped and sized to reside within the engagement profile 88 of the setting sleeve member 82. As the tubing string 40 is lowered through the casing string 17, the collets 96 are deflected radially inwardly until the outwardly projecting portions 98 encounter the engagement profile 88 and snap radially outwardly to reside within the engagement profile 88 to secure the tubing string 40 to the setting sleeve member 82. Then, the tubing string 40 is raised to cause the setting sleeve member 82 and urge the ramped surface of tapered bore portion 90 axially against the outer radial surface 77 of the sealing element 72. This axial movement causes the body 74 of the sealing element 72 to be cammed radially inwardly and deformed radially inwardly against the production tubing string 40. Operation of the body lock ring assembly 37 will maintain the packer assembly 30" in the set position.

Variations on the packer device 30" are possible wherein the sealing element 72 is formed entirely of metal and without the elastomeric sealing portions 76. When the packer device 30" is set, a metal-to-metal seal is formed. Such a variation may be advantageous in many instances wherein, for example, there is a minimum amount of movement of the components needed to form an effective seal. Where a fully metallic sealing element is employed, the sealing element may be a bellow-type seal or a hydroformed seal or ring element. Additionally, a metal-to-metal seal may incorporate toothed slips, of a type known in the art, or other mechanisms for creating a biting engagement between the tubing string 40 and the surrounding casing string 17.

Currently, each of the packer devices 30, 30' and 30" are permanently set packer devices. They may be removed from the wellbore, if desired, by use of a suitable milling tool, as is known in the art.

Figure 8:
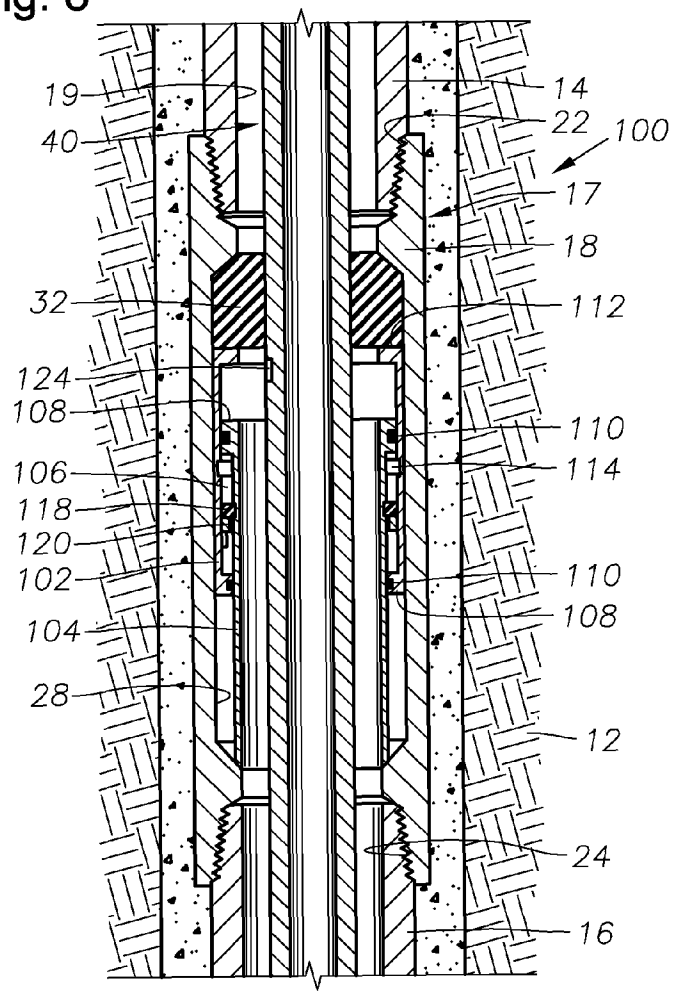
FIG. 8 is a side, cross-sectional view of the packer device shown in FIG. 7, now having been actuated to a set position.
Figure 7:
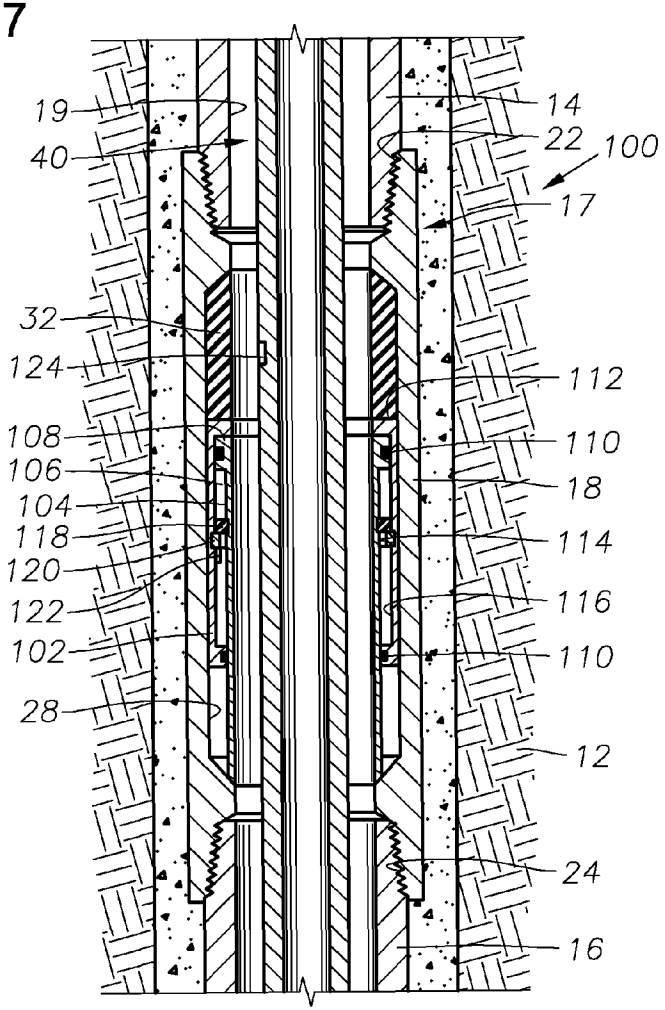
FIG. 7 is a side, cross-sectional view of an alternative packer device constructed in accordance with the present invention and utilizing a hydraulic setting arrangement for setting the packer device.

FIGS. 7 and 8 illustrate a further exemplary packer device 100 that employs an energy source that is contained within the casing string 17 prior to disposing the tubing string 40 into the casing string 17. The enlarged diameter chamber 28 of the casing coupler 18 contains an outer collar 102 and an inner collar 104. The inner collar 104 is disposed radially within the outer collar 102, and a chamber 106 is defined radially between the two collars 102, 104. Flanged end portions 108 and seals 110 are provided for each of the collars 102, 104. The outer collar 102 presents an upper axial end portion 112 that lies in contact with the sealing element 32. A recess 114 is inscribed within the interior radial surface 116 of the outer collar 102. An annular seal member 118 is fixedly secured to the inner collar 104 and is, in turn, secured to a split ring, or C-ring member 120. In the unset position, depicted in FIG. 7, the split ring 120 resides within the recess 114 of the outer collar 102. As noted, the chamber 106 is defined radially between the inner and outer collars 102, 104, at its upper end by seal 110, and at its lower end by seal member 118. A split ring actuator 122 (visible in FIG. 7) is operably interconnected with the split ring 120. The split ring actuator 122 preferably comprises a programmable electronic transceiver that is designed to receive a triggering signal from a transmitter. Signal transmitter 124 is incorporated within the tubing string 40. In one currently preferred embodiment, the signal transmitter 124 may comprise an RFID (radio frequency identification) tag or chip which is designed to emit a triggering signal upon passing within a certain proximate distance of the actuator 122. The actuator 122 is operably associated with the split ring 120 to retract the split ring 120 radially inwardly and out of the recess 114 upon receipt of the signal from the transmitter 124. Radial retraction of the split ring 120 may be done by the actuator mechanically, magnetically, or using other suitable known techniques.

The chamber 106 may be an atmospheric chamber or a more highly pressurized chamber, which will create a pressure differential across the seal member 118 which will urge the end portion 112 of the outer collar 102 toward the sealing element 32 and a set position. In variations on this embodiment, the chamber 106 could be replaced with a mechanical spring to serve as an energy source to bias the outer collar 102 toward the sealing element 32. Additionally, the transmitter 124 and actuator 122 could be replaced by a mechanical trigger arrangement wherein the spring is mechanically released from a compressed state by engaging a release latch for the spring with an engagement member within the tubing string 40.

In operation, the packer device 100 is in the initially unset position shown in FIG. 7. The tubing string 40 is lowered into the casing string 17 until the transmitter 124 is located proximate the actuator 122. The triggering signal is received by the actuator 122, which then releases the split ring 120 from the recess 114. If desired, a delay could be incorporated into the programming of the actuator 122 such that a predetermined period of time elapses between the time the triggering signal is received by the actuator 122 and the split ring 120 is released from the recess 114. When the split ring 120 is released from the recess 114, fluid pressure within the chamber 106 will urge the outer collar 102 axially upwardly so that the upper end 112 will compress the sealing element 32. The sealing element 32 will be deformed radially inwardly to seal against the tubing string 40, as depicted in FIG. 8 to create a seal.

Figure 10:
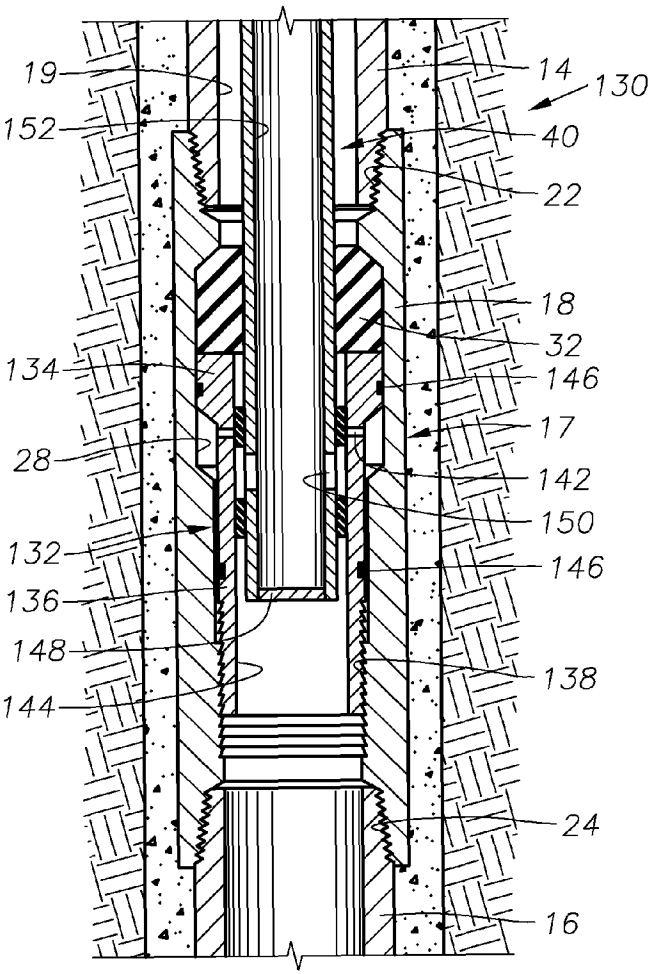
FIG. 10 is a side, cross-sectional view of the packer device shown in FIG. 9, now having been actuated to a set position.
Figure 9:
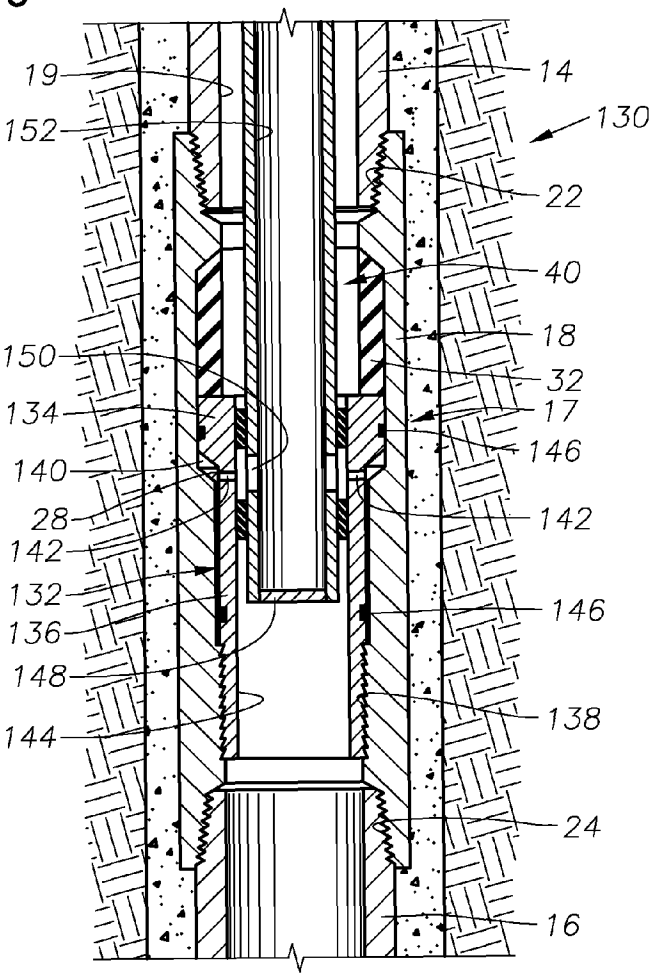
FIG. 9 is a side, cross-sectional view of an alternative packer device also utilizing a hydraulic setting arrangement.

Referring now to FIGS. 9 and 10, a further exemplary packer device 130 is depicted which utilizes hydraulic setting via the tubing string 40. The sealing element 32 is retained within the chamber 28 along with a setting piston 132. The setting piston 132 features an enlarged compression head portion 134 that abuts the sealing element 32 and a reduced diameter stem portion 136 that extends downwardly from the head portion 134. A ratchet mechanism 138 is located at its lower end of the stem portion 136 and operates in the manner of a body lock ring to ensure one-way sequential movement of the setting piston 132 with respect to the surrounding casing coupler 18.

A fluid chamber 140 is defined between the setting piston 132 and the casing string 17 within the enlarged chamber 28. Fluid flow ports 142 are disposed through the setting piston 132 to permit fluid communication between the fluid chamber 140 and the interior flowbore 144 of the setting piston 132. Fluid seals 146 are provided between the setting piston 132 and the casing coupler 18 to ensure fluid tightness of the fluid chamber 140.

The lower end of the tubing string 40 is closed off by a plug 148. The plug 148 is preferably a temporary or removable plug which can be removed to allow flow through the tubing string 40 at a later point during production operations. Ports 150 are disposed through the side of the tubing string 40.

In operation, the packer device 130 is initially in the unset position depicted in FIG. 9. The tubing string 40 is then disposed into the casing string 17 until the ports 150 of the tubing string 40 are generally aligned with the fluid flow ports 142 in the setting piston 132. The interior flowbore 152 of the tubing string 40 is then pressurized so that fluid is flowed through the aligned ports 150 and 142 and into the fluid chamber 140. The setting piston 132 is urged upwardly by the fluid pressure so that the enlarged head portion 134 compresses the sealing element 32. Axial compression of the sealing element 32 causes the sealing element 32 to deform radially inwardly and seal against the tubing string 40, as depicted in FIG. 10. The ratchet mechanism 138 ensures that the packer device 130 remains in the set position.

Figure 11:
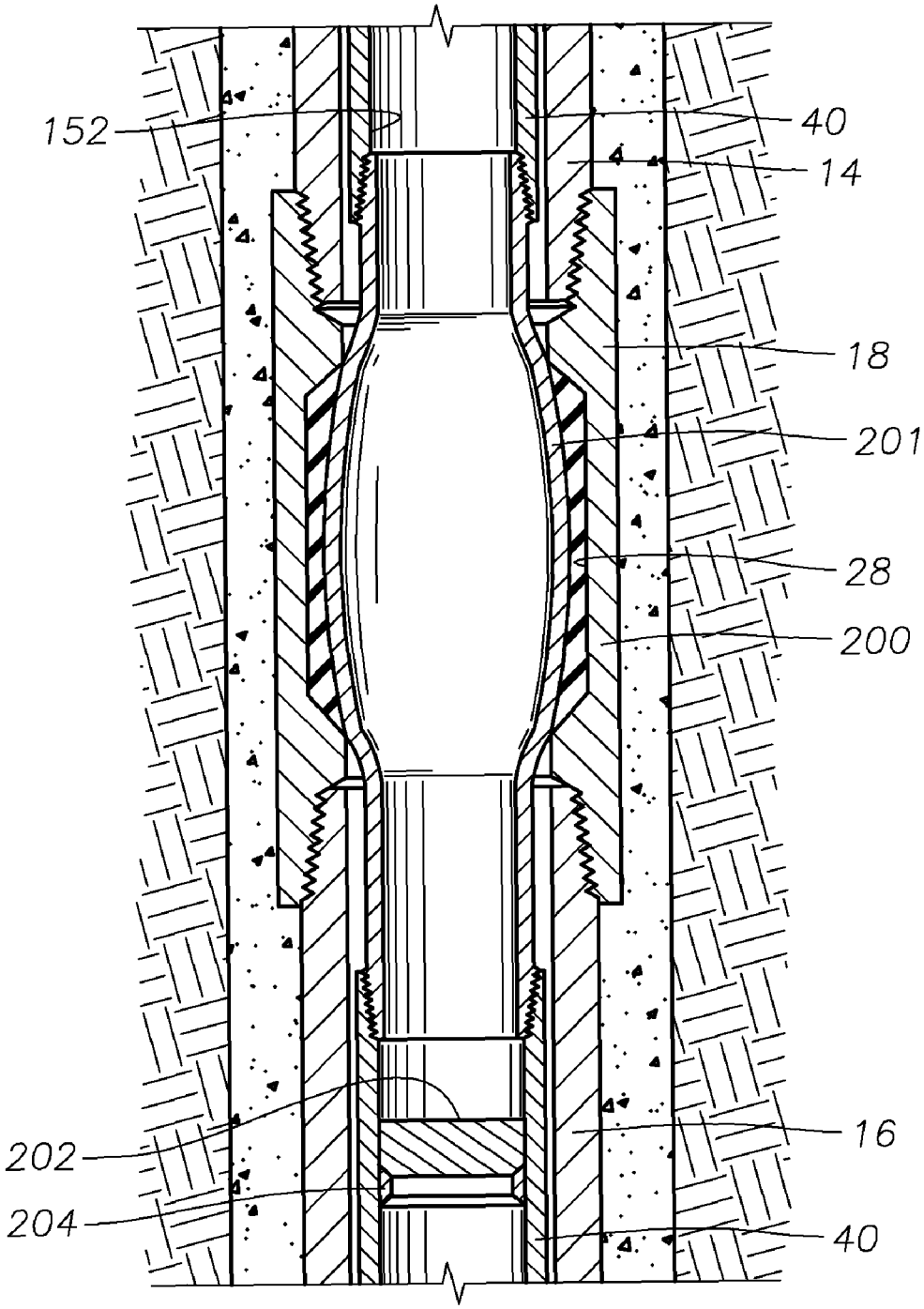
FIG. 11 is a side, cross-sectional view of a further exemplary packer device which incorporates a ductile, radially expandable tube.

FIG. 11 depicts a further exemplary embodiment of the invention wherein a sealing element 200 is contained within the chamber 28 of the casing coupler 18 and an inflatable, or radially expandable, ductile tube 201 is made up into the production tubing string 40. The ductile tube 201 is formed of a material that permits the tube 201, or portions thereof, to be deformed radially outwardly. One such material is a nickel alloy. To create a seal, the ductile tube 201 is inflated or expanded radially outwardly until its radially outer surface is brought into sealing contact with the sealing element 200. The ductile tube 201 can be inflated or expanded radially outwardly using a number of techniques for radially expanding ductile tubular members. One technique for inflating the ductile tube 201 is to seat a dart, ball, or other plug member 202 upon a seat 204 to seal off the flowbore 152 of the tubing string 40 below the ductile tube 201. Fluid pressure is then increased within the flowbore 152 above the plug member 202 to cause the ductile tube 201 to expand radially outwardly, as illustrated in FIG. 11. In this embodiment, as well, the plug member 202 may be a temporary or removable plug member. Alternatively, a mechanical means, such as a suitable swaging instrument, can be used to radially expand the ductile tube 201 radially outwardly.

The sealing element 200 may be a metallic sealing element or a non-metallic sealing element. In one embodiment, the sealing element 200 is an elastomeric sealing element. In another embodiment, the sealing element 200 is a mechanical sealing element and contains toothed portions to form a biting engagement with the ductile tube 201. The design of the sealing element 200 will preferably provide fluid sealing and mechanical retention between the inflatable tubing 201 and the casing coupler 18. The sealing contact between the ductile tube 201 and the sealing element 200 forms a retention device between the tubing string 40 and the surrounding casing string that is capable of withstanding high axial tubing loads.

Those of skill in the art will appreciate that the present invention provides a novel wellbore packer arrangement as well as a wellbore production system that includes an outer tubular string having an enlarged diameter chamber portion; an inner tubular string; a packer device disposed at least partially within the enlarged chamber to form a seal against the inner tubular string.

The present invention also provides methods of establishing a seal between inner and outer tubular string members within a wellbore wherein a packer device is disposed within an enlarged diameter chamber portion of an outer tubular string. The outer tubular string, such as a string of casing or liner, is run into a wellbore and cemented in place. At this point the packer device is in an unset position. Next, the inner tubular string is run into the outer tubular string to a predetermined depth or position within the outer string. The predetermined depth or position will typically correspond to the proper location of a tool, such as a production nipple, inside the outer tubular string. The packer device is then actuated from an unset to a set position to form a seal against a member of the inner tubular string.

Those of skill in the art will recognize that numerous modifications and changes may be made to the exemplary designs and embodiments described herein and that the invention is limited only by the claims that follow and any equivalents thereof.

What is claimed is:

1. A packer arrangement for forming a seal between an inner tubular string and an outer tubular string in a wellbore, the packer arrangement comprising:

an outer tubular member in the outer tubular string and defining an axial flowbore;

a packer device disposed at least partially within the outer tubular member to form a seal against an inner tubular member within the inner tubular string;

an inner tubular member to be disposed within the axial flowbore on the inner tubular string, and having a tube portion that is radially outwardly expandable to create a seal between the tube portion and the packer device; and the inner tubular string is retained by the seal within the outer tubular string wherein an annular region is located between the inner tubular string and the outer tubular string.

2. The packer arrangement of claim 1 further comprising:

an inner flowbore defined within the inner tubular member and having a plug seat formed therein; and a plug member to be disposed within the inner flowbore and seated upon the plug seat so that fluid pressure above the plug member in the inner flowbore will radially expand the tube portion.

3. The packer arrangement of claim 1 wherein the inner tubular member is expanded radially outwardly by mechanical swaging.

4. The packer arrangement of claim 1 wherein the inner tubular member is formed of a nickel alloy.

5. The packer arrangement of claim 1 wherein the packer device comprises a metallic sealing element.

6. The packer arrangement of claim 1 wherein the packer device comprises an elastomeric sealing element.

7. The packer arrangement of claim 1 wherein the packer device comprises a sealing element which forms a biting engagement with the inner tubular member.

8. A packer arrangement for forming a seal between an inner tubular string and an outer tubular string in a wellbore, the packer arrangement comprising:

an outer tubular string member in the outer tubular string and defining an axial flowbore;

a packer device disposed at least partially within the outer tubular string member to form a seal against an inner tubular member within the inner tubular string;

an inner tubular member to be disposed within the axial flowbore on the inner tubular string, and having a tube portion that is radially outwardly expandable to create a seal between the tube portion and the packer device;

an inner flowbore defined within the inner tubular member and having a plug seat formed therein; and a plug member to be disposed within the inner flowbore and seated upon the plug seat so that fluid pressure above the plug member in the inner flowbore will radially expand the tube portion.

9. The packer arrangement of claim 8 wherein the inner tubular member is formed of a nickel alloy.

10. The packer arrangement of claim 8 wherein the packer device comprises a metallic sealing element.

11. The pack er arrangement of claim 8 wherein the packer device comprises an elastomeric sealing element.

12. The packer arrangement of claim 8 wherein the packer device comprises a sealing element which forms a biting engagement with the inner tubular member.

13. A method of establishing a seal within a wellbore between an outer tubular string and an inner tubular string, comprising the steps of:

disposing an outer tubular string within a wellbore, the outer tubular string containing an outer tubular member having an enlarged diameter chamber portion with a packer device residing at least partially within the chamber portion;

disposing an inner tubular string within the outer tubular string, the inner tubular string having an inner tubular member with a tube portion that is radially outwardly expandable; and expanding the tube portion radially outwardly to bring the tube portion into sealing contact with the packer device wherein an annular region is located between the inner tubular string and the outer tubular string.

14. The method of claim 13 further comprising an inner flowbore defined within the inner tubular member and having a plug seat formed therein, and wherein the step of expanding the tube portion further comprises:

landing a plug member on the plug seat; and increasing fluid pressure within the inner flowbore above the plug member to cause the tube portion to expand radially outwardly.

15. The method of claim 13 wherein the step of expanding the tube portion further comprises expanding the tube portion by mechanical swaging.

* * * * *